US009405237B2

(12) United States Patent
Fromm et al.

(10) Patent No.: US 9,405,237 B2
(45) Date of Patent: Aug. 2, 2016

(54) TRANSFER STATION FOR A LIQUID TONER PRINTING SYSTEM

(71) Applicant: Oce Printing Systems GmbH & Co. KG, Poing (DE)

(72) Inventors: Matthias Fromm, Markt Schwaben (DE); Volkhard Maess, Pliening (DE); Georg Landmesser, Haar (DE); Thomas Montag, Unterhaching (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/953,937

(22) Filed: Nov. 30, 2015

(65) Prior Publication Data

US 2016/0154346 A1 Jun. 2, 2016

(30) Foreign Application Priority Data

Nov. 28, 2014 (DE) ..... 10 2014 117 493

(51) Int. Cl.
*G03G 15/16* (2006.01)

(52) U.S. Cl.
CPC ..... *G03G 15/1665* (2013.01); *G03G 15/1695* (2013.01)

(58) Field of Classification Search
CPC ..... G03G 15/1695; G03G 15/1635; G03G 15/161; G03G 15/162; G03G 15/163
USPC ..... 399/311, 314, 310, 121
See application file for complete search history.

(56) References Cited

U.S. PATENT DOCUMENTS

| | | | | |
|---|---|---|---|---|
| 4,189,643 | A | 2/1980 | Wieloch | |
| 4,341,457 | A * | 7/1982 | Nakahata | G03G 15/1645 361/225 |
| 5,481,339 | A | 1/1996 | De Cock et al. | |
| 6,266,499 | B1 | 7/2001 | Murata et al. | |
| 2005/0220518 | A1 | 10/2005 | Priebe | |
| 2011/0033212 | A1 * | 2/2011 | Suzuki | G03G 15/161 399/296 |
| 2013/0272749 | A1 * | 10/2013 | Montag | G03G 15/104 399/251 |

FOREIGN PATENT DOCUMENTS

| | | | |
|---|---|---|---|
| DE | 1522619 | B2 | 6/1976 |
| DE | 3034089 | A1 | 4/1981 |
| DE | 102005041848 | A1 | 3/2007 |
| JP | S5842076 | A | 3/1983 |
| JP | S6151178 | A | 3/1986 |

* cited by examiner

*Primary Examiner* — Walter L Lindsay, Jr.
*Assistant Examiner* — Jessica L Eley
(74) *Attorney, Agent, or Firm* — Schiff Hardin LLP

(57) ABSTRACT

In a method or a transfer station for a digital printer, liquid developer with toner particles can be directed towards a first side of a recording medium and onto the first side of the recording medium at a transfer point. A transfer roller can be configured to direct the liquid developer towards the recording medium. The toner particles can have a first polarity and the recording medium can move past the transfer roller along a transport direction. A layer of charged particles can be applied from a second side of the recording medium by a surface charging station. The surface charging station can be arranged before the transfer point in the transport direction. The second side of the recording medium can be opposite the first side. The charged particles can have a second polarity that is opposite the first polarity.

12 Claims, 3 Drawing Sheets

TRANSFER STATION FOR A LIQUID TONER PRINTING SYSTEM

CROSS REFERENCE TO RELATED APPLICATIONS

This patent application claims the benefit of German Patent Application No. 102014117493.3, filed Nov. 28, 2014, which is incorporated herein by reference in its entirety.

BACKGROUND

The exemplary embodiments described herein generally relate to a digital printer for printing to a recording medium with toner particles that are applied with the aid of a liquid developer, including high-capacity printing systems for printing to web-shaped or sheet-shaped recording media.

Given such digital printers, a latent charge image of a charge image carrier is inked by means of electrophoresis, with the aid of a liquid developer. The toner image that is created in such a manner is indirectly transferred to the recording medium via a transfer element (i.e. via a transfer station). The print image is subsequently fixed on the recording medium. In the transfer step, an electrical field is used in order to transfer the toner image to the recording medium.

In numerous use cases, in particular in printing of packaging, recording media with a significant thickness (for example paper grammages of up to 450 g/m$^2$) are used. Given use of such thick recording media, the degree of transfer efficiency—and therefore the print quality—typically decreases.

SUMMARY

It is an object to provide a printing system having an efficiently and reliably increased transfer efficiency of the transfer station of the printing system, where the transfer station transfers a toner image to a recording medium by means of electrophoresis.

In a method or a transfer station for a digital printer, liquid developer with toner particles can be directed towards a first side of a recording medium and onto the first side of the recording medium at a transfer point. A transfer roller can be configured to direct the liquid developer towards the recording medium. The toner particles can have a first polarity and the recording medium can move past the transfer roller along a transport direction. A layer of charged particles can be applied from a second side of the recording medium by a surface charging station. The surface charging station can be arranged before the transfer point in the transport direction. The second side of the recording medium can be opposite the first side. The charged particles can have a second polarity that is opposite the first polarity.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

According to an exemplary embodiment, a transfer station for a digital printer is described. The transfer station comprises a transfer roller that is configured to direct liquid developer with toner particles towards a first side of a recording medium and—at a transfer point—onto the first side of the recording medium. The toner particles have a first polarity. The recording medium moves past the transfer roller along a transport direction. The transfer station additionally comprises a surface charging station arranged before the transfer point (in the transport direction), which surface charging station is configured to apply a (charged) layer of charged particles from a second side of the recording medium. The second side is opposite the first side. Furthermore, the charged particles have a second polarity that is opposite the first polarity.

According to an additional aspect, a print group is described that comprises the transfer station described in this document. Moreover, a digital printer is described that comprises at least one such print group.

According to an additional aspect, a method is described for increasing the toner transfer efficiency of a transfer station. The method includes the application of a (charged) layer of charged particles from a second side of a recording medium. The charged particles have a second polarity. Furthermore, the method includes the transfer of toner particles from a liquid developer onto a first side of the recording medium that is opposite the second side. The toner particles have a first polarity that is opposite the second polarity.

Figure 1:
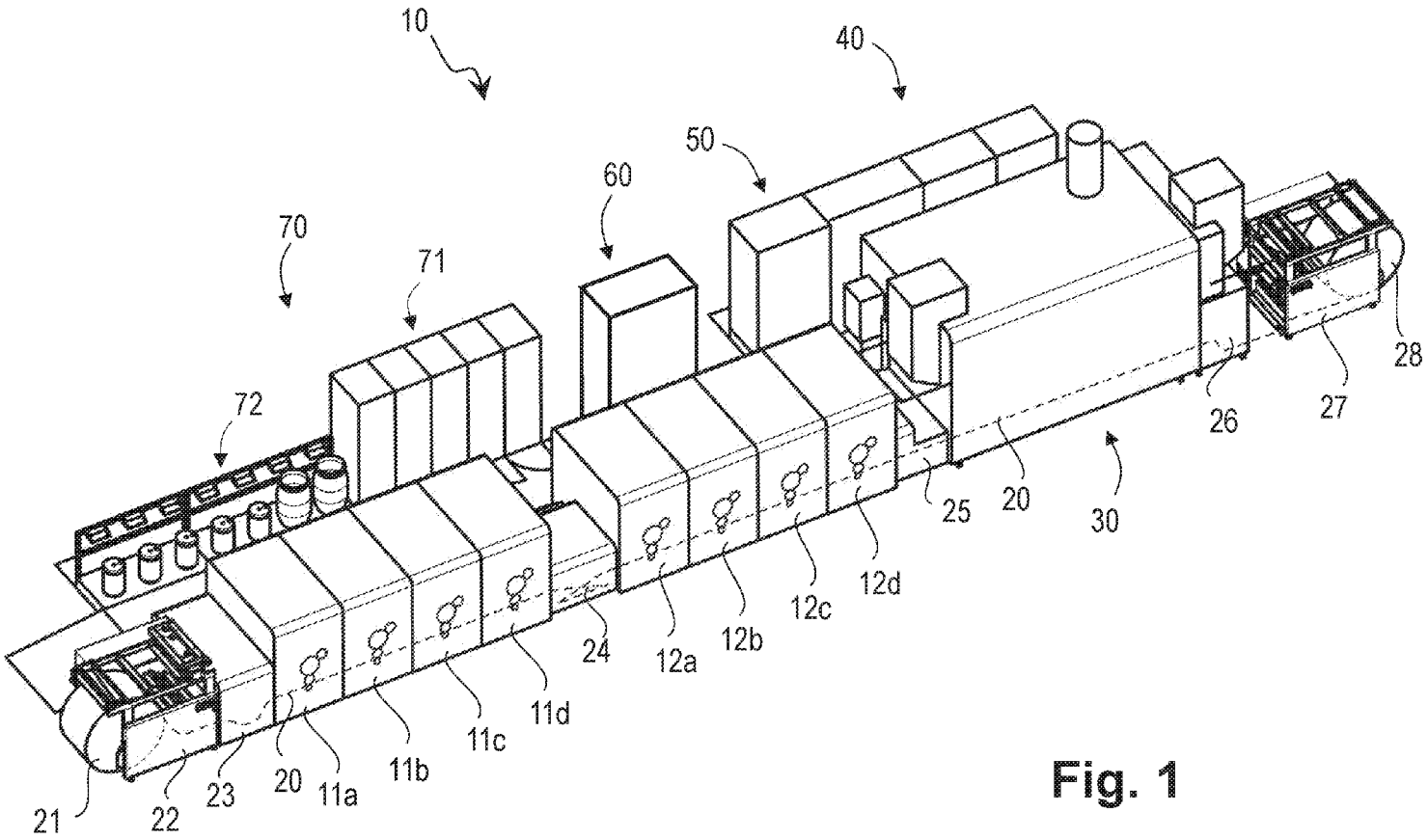
FIG. 1 illustrates a printer according to an exemplary embodiment of the present disclosure.

According to FIG. 1, a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium 20 as a recording medium 20 is unspooled from a roll 21 with the aid of a take-off 22 and is supplied to the first print group 11*a*. The print image 20' is fixed on the recording medium 20 in a fixer 30. The recording medium 20 may subsequently be taken up on a roll 28 with the aid of a take-up 27. Such a configuration is also known as a roll-to-roll printer.

In the configuration shown in FIG. 1, the web-shaped recording medium 20 is printed to in full color on the front side with four print groups 11*a* through 11*d*, and on the back side with four print groups 12*a* through 12*d* (what is known as a 4/4 configuration). For this, the recording medium 20 is unwound from the roll 21 by the take-off 22 and supplied to the first print group 11*a* via an optional conditioning group 23. In the conditioning group 23, the recording medium 20 may be pre-treated or coated with a suitable substance. Wax, or chemically equivalent substances, may preferably be used as a coating substance (also known as a primer).

The coating substance may be applied over the entire area or only at the points of the recording medium 20 that are to be printed to later, in order to prepare the recording medium 20 for printing and/or in order to affect the absorption behavior of the recording medium 20 upon application of the print image 20'. It is therefore prevented that the toner particles or the carrier fluid that are applied later do not penetrate too far into the recording medium 20, but rather remain essentially at the surface (whereby the color quality and image quality are improved).

The recording medium 20 is subsequently supplied first, in order, to the first print groups 11*a* through 11*d*, in which only the front side is printed to. Each print group 11*a*-11*d* typically prints to the recording medium 20 in a different color, or also with a different toner material (for example MICR toner which can be read electromagnetically).

After printing to the front side, the recording medium 20 may be turned in a turner 24 and be supplied to additional print groups 12*a*-12*d* for printing to the back side. In the region of the turner 24, an additional conditioning group (not shown in FIG. 1) may be arranged via which the recording medium 20 is prepared for the printing to the back side, for example an intermediate fixer (described in this document) to fix (at least partially fix) the previously printed front-side print image. It is thus prevented that the front-side print image is mechanically damaged upon further transport through the subsequent print groups.

In order to achieve a full-color printing, at least four colors (and therefore at least four print groups 11, 12) are required, and in fact the primary colors YMCK (Yellow, Magenta, Cyan and Black), for example. Still more print groups 11, 12 with special colors (for example customer-specific colors or additional primary colors in order to expand the printable color space) may also be used.

Arranged after the print group 12*d* is a register 25 via which registration marks—which are printed on the recording medium 20 independently of the print image 20' (in particular outside of the print image 20')—are evaluated. The transversal and longitudinal registration (the primary color dots that form a color point should be arranged atop one another or spatially very close to one another; this is also known as color registration or four-color registration) and the registration (front side and back side must spatially coincide precisely) can therefore be adjusted so that a qualitatively good print image 20' is achieved.

Arranged after the register 25 is the fixer 30 via which the print image 20' is fixed on the recording medium 20. Given electrophoretic digital printers, a thermal dryer is preferably used that largely evaporates the carrier fluid so that only the toner particles still remain on the recording medium 20. Thus occurs under the effect of heat. The toner particles may thereby also be fused onto the recording medium 20 insofar as they have a material (resin, for example) that can melt as a result of the effect of heat.

Arranged after the fixer 30 is a puller 26 that pulls the recording medium 20 through all print groups 11*a*-12*d* and the fixer 30 without an additional drive being arranged in this region. The danger that the as of yet unfixed print image 20' could be smeared would exist due to a friction drive for the recording medium 20.

The puller 26 feeds the recording medium 20 to the take-up 27, which rolls up the printed recording medium 20.

Centrally arranged in the print groups 11, 12 and the fixer 30 are all supply devices for the digital printer 10, such as climate controller 40 (e.g., air-conditioner), power supply 50, controller 60, fluid management system 70 (such as fluid controller 71 and reservoirs 72 of the different fluids). In particular, pure carrier fluid, highly-concentrated liquid developer (high proportion of toner particles in relation to carrier fluid) and serum (liquid developer plus charge control substances) are required as fluids in order to supply the digital printer 10, as well as waste containers for fluids to be disposed of or containers for cleaning fluid. In one or more exemplary embodiments, the climate controller 40, power supply 50, controller 60, and/or fluid management system 70 can include processor circuitry configured to perform their corresponding functions.

The digital printer 10, with its structurally identical print groups 11, 12, is of modular design. The print groups 11, 12 do not differ mechanically, but rather only due to the liquid developer (toner color or toner type) used therein.

Figure 2:
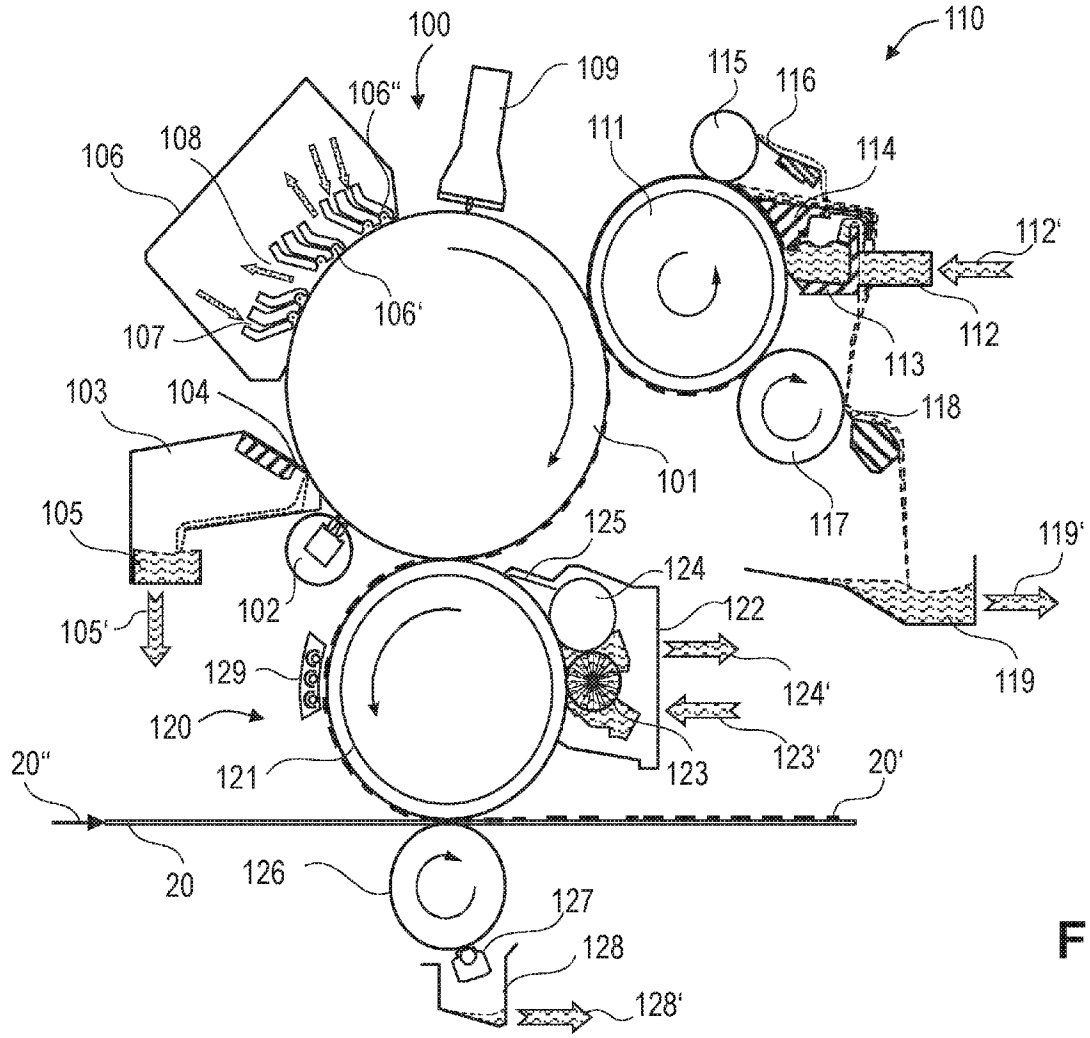
FIG. 2 illustrates a schematic design of a print head of the printer of FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a manner is transferred to the recording medium 20.

The print group 11, 12 is essentially comprised of an electrophotography station 100, a developer station 110 and a transfer station 120.

The core of the electrophotography station 100 is a photoelectric image carrier that has a photoelectric layer (what is known as a photoconductor) on its surface. The photoconductor here is designed as a roller (photoconductor roller 101) and has a hard surface. The photoconductor roller 101 rotates past the various elements to generate a print image 20' (rotation in the arrow direction).

The photoconductor 101 is initially cleaned of all contaminants. For this, an erasure light 102 is present that erases charges that still remain on the surface of the photoconductor 101. The erasure light can be calibrated (is locally adjustable) in order to achieve a homogeneous light distribution. The surface may therefore be pre-treated uniformly.

After the erasure light 102, a cleaner 103 mechanically cleans off the photoconductor 101 in order to remove toner particles that are possibly still present on the surface of the photoconductor 101, possible dirt particles and remaining carrier fluid. The cleaned-off carrier fluid is supplied to a collection container 105. The collected carrier fluid and toner particles are prepared (possibly filtered) and fed—depending on color—to a corresponding liquid color reservoir, i.e. to one of the storage containers 72 (see arrow 105').

The cleaner 103 preferably has a blade 104 that rests on the surface shell of the photoconductor roller 101 at an acute angle (approximately 10° to 80° relative to the outflow surface) in order to mechanically clean off the surface. The blade 104 may move back and forth, transversal to the rotation direction of the photoconductor roller 101, in order to optimally clean the surface shell along the entire axial length with as little wear as possible.

The photoconductor 101 is subsequently charged by a charger 106 to a predetermined electrostatic potential. For this, multiple corotrons (in particular glass shell corotrons) are preferably present. The corotrons are comprised of at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 106 for aeration and exhaust channel 108 for ventilation) between the shields (see also the air flow arrows in FIG. 2). The supplied air is then uniformly ionized at the wire 106'. A homogeneous, uniform charging of the adjacent surface of the photoconductor 101 is thereby achieved. The uniform charging is further improved with dry and heated air. Air is discharged via the exhaust channels 108. Ozone that is possibly created may likewise be drawn away via the exhaust channels 108.

The corotrons can be cascaded, meaning that then two or more wires 106' are present per shield 106" given the same shielding voltage. The current that flows across the shield 106" is adjustable, and the charge of the photoconductor 101 is thereby controllable. The corotrons may be fed with currents of different strengths in order to achieve a uniform and sufficiently high charge at the photoconductor 101.

Arranged after the charger 106 is a character generator 109 that, via optical radiation, discharges the photoconductor 101 per pixel depending on the desired print image 20'. A latent image is thereby created that is later inked with toner particles (the inked image corresponds to the print image 20'). A light emitting diode (LED) character generator 109 is preferably used in which an LED line with many individual LEDs is arranged stationary over the entire axial length of the photoconductor roller 101. The number of LEDs and the size of the optical mapping points on the photoconductor 101 determine (among other things) the resolution of the print image 20' (e.g., resolution of 600×600 dpi). The LEDs may be controlled with individual timing and with regard to their radiation power. To generate raster points (comprised of multiple image points or pixels), multi-level methods may thus be applied or image points may be chronologically delayed in order to electro-optically implement corrections, for example given an incorrect color registration or register.

The character generator 109 has a control logic that must be cooled due to the plurality of LEDs and their radiation power. The character generator 109 is preferably liquid-cooled. The LEDs may be activated in groups (multiple LEDs combined into a group) or separately from one another.

The latent image generated by the character generator 109 is inked with toner particles by the developer station 110. The developer station 110 has for this a rotating developer roller 111 that directs a layer of liquid developer towards the photoconductor 101 (the functionality of the developer station 110 will be explained in detail further below). Since the surface of the photoconductor roller 101 is relatively hard, the surface of the developer roller 111 is relatively soft, and if the two are pressed against one another a thin, high nip (a gap between the rollers) is created in which the charged toner particles migrate electrophoretically from the developer roller 111 onto the photoconductor 101 at the image points, due to an electrical field. No toner transfers to the photoconductor at the non-image points. The nip filled with liquid developer has a height (width of the gap) that is dependent on the mutual pressure of the two rollers 101, 111 and the viscosity of the liquid developer. The height of the nip is typically in a range of greater than approximately 2 μm up to approximately 20 μm (the values may also change depending on viscosity of the liquid developer). The length of the nip is approximately a few millimeters.

The inked image rotates with the photoconductor roller 111 up to a first transfer point at which the inked image is essentially completely transferred to a transfer roller 121. At the first transfer point (nip between photoconductor roller 101 and transfer roller 121), the transfer roller 121 moves in the same direction as the photoconductor 101 and preferably at an identical speed. After the transfer of the print image 20' to the transfer roller 121, the print image 20' (toner particles) may optionally be recharged or charged with the original polarity by means of a charger 129 (a corotron, for example) in order to be able to subsequently better transfer the toner particles to the recording medium 20.

The recording medium 20 travels through between the transfer roller 121 and a counter-pressure roller 126, in the transport direction 20". The contact region (nip) represents a second transfer point at which the toner image is transferred to the recording medium 20. In the second transfer region, the transfer roller 121 moves in the same direction as the recording medium 20. The counter-pressure roller 126 also rotates in this direction in the region of the nip. The velocities of the transfer roller 121, the counter-pressure roller 126 and the recording medium 20 are matched to one another at the transfer point and are preferably identical so that the print image 20' is not smeared. At the second transfer point, the print image 20' may be electrophoretically transferred onto the recording medium 20 due to an electrical field between the transfer roller 121 and the counter-pressure roller 126. Moreover, the counter-pressure roller 126 typically presses against the relatively soft transfer roller 121 with a large mechanical force, whereby the toner particles may also remain stuck to the recording medium 20 due to the adhesion.

Since the surface of the transfer roller 121 is relatively soft and the surface of the counter-pressure roller 126 is relatively hard, upon rolling a nip is created in which the toner transfer occurs. Unevenness of the recording medium 20 may therefore be compensated so that the recording medium 20 may be printed to without gaps. Such a nip is also well suited in order to print to thicker or more uneven recording media 20, for example as is the case given printing of packaging.

The print image 20' should in fact transfer completely to the recording medium 20; nevertheless, a few toner particles may undesirably remain on the transfer roller 121. A portion of the carrier fluid always remains on the transfer roller 121 as a result of the wetting. The toner particles that are possibly still present should be nearly completely removed by a second cleaner 122 following the second transfer point. The carrier fluid still located on the transfer roller 121 may also be completely removed from the transfer roller 121, or removed up to a predetermined layer thickness so that, after the cleaner 122 and before the first transfer point from the photoconductor roller 101 to the transfer roller 121, the same conditions prevail due to a clean surface or a defined layer thickness with liquid developer on the surface of the transfer roller 121.

This cleaner 122 is preferably designed as a wet chamber with a cleaning brush 123 and a cleaning roller 124. In the region of the brush 123, cleaning fluid (for example, carrier fluid or a separate cleaning fluid may be used) is supplied via a cleaning fluid feed 123'. The cleaning brush 123 rotates in the cleaning fluid and thereby "brushes" the surface of the transfer roller 121. The toner adhering to the surface is thereby loosened.

The cleaning roller 124 is at an electrical potential that is opposite the charge of the toner particles. As a result of this, the electrically charged toner is removed from the transfer roller 121 by the cleaning roller 124. Since the cleaning roller 124 contacts the transfer roller 121, it also removes carrier fluid (together with the supplied cleaning fluid) remaining on said transfer roller 121. A conditioning element 125 is arranged at the outflow from the wet chamber. As shown, a retention plate that is arranged at an obtuse angle (for instance between 100° and 175° between plate 125 and outflow surface) relative to the transfer roller 121 may be used as a conditioning element 125, whereby residues of fluid on the surface of the roller are nearly completely kept back in the wet chamber and supplied to the cleaning roller 124 for removal via a cleaning fluid discharge 124' to a cleaning fluid reservoir (at the reservoirs 72) (not shown).

Instead of the retention plate 125, a doser (not shown) may also be arranged there that, for example, has one or more dosing rollers. The dosing rollers have a predetermined clearance from the transfer roller 121 and remove so much carrier fluid that a predetermined layer thickness appears after the dosing roller as a result of the squeezing. The surface of the transfer roller 121 is then not completely cleaned off; carrier fluid of a predetermined layer thickness remains over the entire surface. Removed carrier fluid is directed back via the cleaning roller 124 to the cleaning fluid reservoir.

The cleaning roller 124 itself is kept mechanically clean by a blade (not shown). Fluid that is cleaned off, inclusive of toner particles, is captured for all colors by a central capture container, cleaned, and supplied to the central cleaning fluid reservoir for reuse.

The counter-pressure roller 126 is likewise cleaned by a cleaner 127. A blade, a brush and/or a roller may remove contaminants (paper dust, toner particle residues, liquid developer etc.) from the counter-pressure roller 126. The cleaned fluid is collected in a collection container 128 and provided again to the printing process (possibly after cleaning) via a fluid discharge 128'.

In the print groups 11 that print to the front side of the recording medium 20, the counter-pressure roller 126 does not press against the unprinted side (thus the side that is still dry) of the recording medium 20.

Nevertheless, dust/paper particles or other contaminating particles may already be located on the dry side, which particles are then removed by the counter-pressure roller 126. For this, the counter-pressure roller 126 may be wider than the recording medium 20. As a result of this, contaminants outside of the print area may also be cleaned off well.

In the print groups 12 that print to the back side of the recording medium 20, the counter-pressure roller 126 presses directly on the as of yet unfixed, damp print image 20' of the front side. So that the print image 20' is not removed by the counter-pressure roller 126, the surface of the counter-pressure roller 126 may have anti-adhesion properties with regard to toner particles and also with regard to the carrier fluid on the recording medium 20.

The developer station 110 inks the latent print image 20' with a predetermined toner. For this, the developer roller 111 supplies toner particles to the photoconductor. In order to ink the developer roller 111 itself with a layer over its entire surface, liquid developer is initially supplied at a predetermined concentration from a mixing container (not shown; within the fluid controller 71) via a fluid feed 112' to a reservoir chamber 112. From this reservoir chamber 112, the liquid developer is supplied in abundance to a pre-chamber 113 (a type of pan that is open at the top). An electrode segment 114 is arranged towards the developer roller 111, which electrode segment 114 forms a gap between itself and said developer roller 111.

The developer roller 111 rotates through the pre-chamber 113 that is open at the top and thereby carries liquid developer along in the gap. Excess liquid developer flows out from the pre-chamber 113 back to the reservoir chamber 112.

Due to the electrical field (formed by the electrical potentials) between the electrode segment 114 and the developer roller 111, the liquid developer in the gap is divided up into two regions, and in fact into: a layer region in proximity to the developer roller 111, in which layer region the toner particles concentrate (concentrated liquid developer); and a second region in proximity to the electrode segment 114, which is low in toner particles (very low concentration liquid developer).

The layer of the liquid developer is subsequently transported further to a dosing roller 115. The dosing roller 115 squeezes out the upper layer of the liquid developer so that afterward a defined layer thickness of liquid developer—of approximately 5 μm thickness—remains on the developer roller 111. Since the toner particles are essentially located near the surface of the developer roller 111, in the carrier fluid, the outwardly situated carrier fluid is essentially squeezed out or retained and ultimately is returned back to a collection container 119, but not to the reservoir chamber 112.

As a result of this, it is predominantly highly concentrated liquid developer that is conveyed through the nip between dosing roller 115 and developer roller 111. A uniformly thick layer of liquid developer is thus created, with approximately 40 percent by mass toner particles and approximately 60 percent by mass carrier fluid after the dosing roller 115 (the mass ratios may also fluctuate more or less depending on the printing process requirements). This uniform layer of liquid developer is transported in the nip between the developer roller 111 and the photoconductor roller 101. There the image points of the latent image are then electrophoretically inked with toner particles, while no toner transfers to the photoconductor in the area of non-image points. Sufficient carrier fluid is absolutely necessary for electrophoresis. The fluid layer divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 may again be coated with liquid developer under the same conditions and uniformly, remaining toner particles (these essentially represent the negative, untransferred print image) and liquid developer are electrostatically and mechanically removed by a cleaning roller 117. The cleaning roller 117 itself is cleaned by a blade 118. The cleaned-off liquid developer is supplied to the collection container 119 for reuse, to which collection container 119 the liquid developer cleaned off from the dosing roller 115 (by means of a blade 116, for example) and the liquid developer cleaned off from the photoconductor roller 101 (by means of the blade 104) are also supplied.

The liquid developer collected in the collection container 119 is supplied to the mixing container via the fluid discharge 119'. Fresh liquid developer and pure carrier fluid are also supplied to the mixing container as needed. Sufficient fluid at the desired concentration (predetermined ratio of toner particles to carrier fluid) must always be present in the mixing container. The concentration in the mixing container is continuously measured and regulated accordingly depending on the supply of the quantity of the cleaned-off liquid developer and its concentration as well as the quantity and concentration of fresh liquid developer or carrier fluid.

For this, extremely concentrated liquid developer, pure carrier fluid, serum (carrier fluid and charge control substances in order to control the charge of the toner particles) as well as cleaned-off liquid developer may be supplied separately from the corresponding reservoirs 72 to this mixing container.

The photoconductor 101 may preferably be designed in the form of a roller or as a continuous belt. An amorphous silicon may thereby be used as a photoconductor material, or an organic photoconductor material (also known as OPC) may be used.

Instead of a photoconductor 101, other image carriers (such as magnetic, ionizable etc. image carriers) may also be used that do not operate according to the photoelectric principle but rather on which latent images according to other principles are impressed electrically, magnetically or otherwise, which latent images are then inked and ultimately are transferred to the recording medium 20.

LED rows, or also lasers with corresponding scan mechanism, may be used as a character generator 109.

The transfer element 121 may similarly be designed as a roller or as a continuous belt. The transfer element 121 may also be omitted. The print image 20' is then transferred directly from the photoconductor roller 101 to the recording medium 20.

What is to be understood by the term "electrophoresis" is the migration of the charged toner particles in the carrier fluid as a result of the action of an electrical field. In each transfer of toner particles, the corresponding toner particles essentially transfer completely to another element. After the two elements come into contact, the fluid film is split approximately in half as a result of the wetting of the participating elements, such that approximately one half remains adhered to the first element and the remaining portion remains adhered to the other element. The print image 20' is transferred and, in the next part, is then transported further in order to in turn allow an electrophoretic migration of the toner particles in the next transfer region.

The digital printer 10 may have one or more print groups 11 for printing to the front side and, if applicable, one or more print groups 12 for printing to the back side. The print groups 11, 12 may be arranged in a line, an L-shape or a U-shape.

Instead of the take-up 27, post-processing devices (not shown)—such as cutters, folders, stackers etc.—may also be arranged after the puller 26 in order to bring the recording medium 20 into the final form. For example, the recording medium 20 could be processed to such an extent that a finished book is created in the end. The post-processing devices may likewise be arranged in a row or at an angle.

As was previously described as a preferred exemplary embodiment, the digital printer 10 may be operated as a roll-to-roll printer. It is also possible to cut the recording medium 20 into sheets at the end and to subsequently stack the sheets or suitably process them further (roll-to-sheet printer). It is likewise possible to feed a sheet-shaped recording medium 20 to the digital printer 10 and to stack the sheets or process them further at the end (sheet to sheet printer).

If only the front side of the recording medium 20 is printed to, at least one print group 11 with one color is required (simplex printing). The at least one print group 11 may also be designated as a simplex print group. If the back side is also printed to, at least one print group 12 is also required for the back side (duplex printing). The at least one print group 12 may also be designated as a duplex print group. Depending on the desired print image 20' on the front side and back side, the printer configuration includes a corresponding number of print groups for front side and back side, wherein each print group 11, 12 is always designed for only one color or one type of toner.

The maximum number of print groups 11, 12 is only technically dependent on the maximum mechanical tensile load of the recording medium 20 and the free draw length. Typically, arbitrary configurations from a 1/0 configuration (only one print group for the front side to be printed to) up to a 6/6 configuration (in which six print groups may respectively be present for front side and back side of the recording medium 20) are possible. The preferred embodiment (configuration) is shown in FIG. 1 (a 4/4 configuration), with which the full-color printing for front side and back side with the four primary colors is accomplished. The order of the print groups 11, 12 in a four-color printing preferably goes from a print group 11, 12 that prints light (yellow) to a print group 11, 12 that prints dark; for example, the recording medium 20 is printed to from light to dark in the color order Y-C-M-K.

The recording medium 20 may be manufactured from paper, paperboard, cardboard, metal, plastic and/or other suitable printer materials.

As presented above, the present document deals in particular with the technical object of printing to relatively thick recording media 20 reliably and cost-effectively. For the electrophoretic transfer of toner image from the transfer roller 121 onto the recording medium 20, an electrical field is typically applied between transfer roller 121 and counter-pressure roller 126, which electrical field draws the (for example positively charged) toner particles in the direction of the recording medium 20. However, the effective active electrical field is reduced with increasing thickness of the recording medium 20, whereby the transfer efficiency declines and the print quality decreases.

One possibility to compensate for this is to increase the electrical voltage set between the cores of the rollers 121, 126 in order to achieve the same effective active electrical field for transfer of the toner in comparison to a thin recording medium 20. However, the increase of the voltage is typically subject to limitations, for example due to the dielectric strength of the recording medium 20, due to the dielectric strength of an elastomer layer of the transfer roller 121, and/or due to the dielectric strength of the ball bearings of the rollers 121, 126. An increase of the voltage is thus possibly only within a limited scope, and thus only for a limited thickness of the recording medium 20.

Alternatively or additionally, the transfer efficiency may be improved by an increase of the positively charged toner particles. However, such an increase typically leads to print quality artifacts such as the blurring of raster points.

Alternatively or additionally, the effective active electrical field may be increased, and therefore the transfer to the recording medium 20 may be increased, via a pre-treating of the recording medium 20. In particular, the recording medium 20 may be pre-treated with a corotron which charges the top side of the recording medium 20 with the polarity matching the toner system (for example negatively given positive toner particles) before the (second) transfer point.

Given a single-pass multicolor system (for example given the digital printer 10), the surface treatment is only suitable to charge the recording medium 20 once depending on the charge of the toner particles. In a digital printer 10 with a plurality of print groups 11, the surface already has an applied toner layer in a second and all further print groups 11*b*, 11*c*, 11*d*, which applied toner layer affects the properties of the surface of the recording medium 20. A defined charging of the surface of the recording medium 20 for the second and for additional print groups 11*b*, 11*c*, 11*d* by means of the corotron is therefore for the most part not possible at all, or is possibly only with a complicated regulation. Additionally, due to the charging of the corotron at the polarity opposite that of the toner charge, the danger exists that already-deposited toner from upstream print group 11*a* is discharged or has its charge reversed and, in immediately following print group 11*b*, is transferred from the recording medium 20 back onto the transfer roller 121 of said following print group 11*b*.

An additional disadvantage of the corotron charging of the top side of the recording medium 20 is the normally unknown interaction of the charge applied to the surface of the recording medium 20 with the liquid developer. If the charge of the surface is soluble in the liquid developer and more mobile than the toner particles, the charge flows away quickly, meaning that the effective active electrical field decreases relatively quickly upon passage through the nip between transfer roller 121 and counter-pressure roller 161. The transfer efficiency may thus be degraded by the surface treatment.

Therefore, it is proposed to treat the underside of the recording medium 20 by means of a corotron before the electrically assisted transfer point from the transfer roller 121 onto the recording medium 20. A treatment of the underside of the recording medium 20 may in particular take place immediately before the transfer point (for example immediately before the nip between transfer roller 121 and recording medium 20). Via the treatment of the underside of the recording medium 20, ions are applied onto the underside of said recording medium 20, wherein the ions have a polarity that is opposite the polarity of the toner particles in the liquid developer. Via the treatment of the underside of the recording medium 20, the effective field in the liquid developer is thus increased, whereby the transfer efficiency is in turn increased.

The charge applied by the corotron may possibly flow away across the counter-pressure roller 126 and/or through the recording medium 20. The applied charge thereby flows away slower the greater the resistances of the recording medium 20 and/or of the counter-pressure roller 126. Via a suitable design of the recording medium 20 and/or of the counter-pressure roller 126 (for example given use of a dielectric layer), it may thus be achieved that the effective electrical field in the liquid developer is remained for a sufficient length of time in order to provide a sufficient transfer efficiency.

Figure 3:
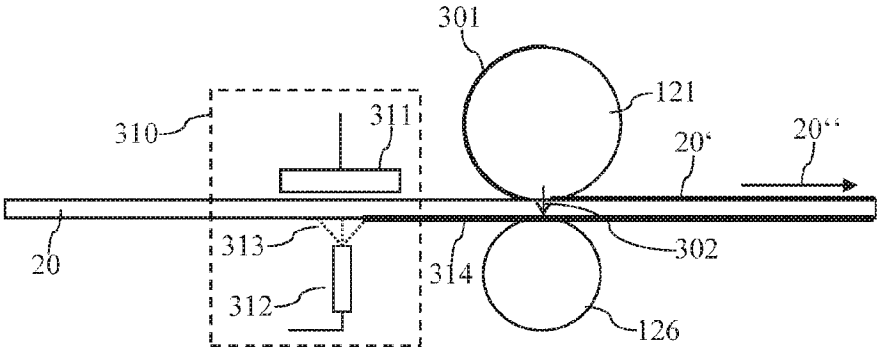
FIG. 3 illustrates a transfer station according to an exemplary embodiment of the present disclosure.

FIG. 3 shows example components of a transfer station 120 for a digital printer 10. In particular, FIG. 3 shows the transfer roller 121 of a transfer station 120. As has already been presented above, the transfer roller 121 is configured to direct liquid developer 301 with toner particles towards a first side of a recording medium 20 and to transfer them onto the first side of the recording medium 20 at a transfer point (for example at the nip). For example, the first side of the recording medium 20 may be the top side of the recording medium 20. The toner particles have a first polarity (for example a positive polarity).

The recording medium 20 is moved past the transfer roller 121 along a transport direction 20". The transfer roller 121 thereby typically moves with a corresponding rotation velocity so that respective different segments of the transfer roller 121 and of the first side of the recording medium 20 meet at the transfer point. The toner particles are typically arranged on the transfer roller 121 according to a print image 20' to be printed on the recording medium 20. The print image 20' is thus created little by little on the first side of the recording medium 20 via the movement of the recording medium 20 and of the transfer roller 121.

The transfer station 120 additionally comprises a surface charging station 310 that is arranged before the transfer point in the transport direction 20". The surface charging station 310 can be configured to generate and/or apply a (charged) layer 314 of charged particles from a second side of the recording medium 20 or to introduce the charged particles into said recording medium 20. In other words: the surface charging station 310 may apply charged particles from the second side of the recording medium 20 onto said recording medium 20. These charged particles then form a charged layer 314 that may also penetrate or partially penetrate from the second side of the recording medium 20 into the inside of said recording medium 20. The second side is thereby opposite the first side. For example, the second side is the underside of the recording medium 20, and the first side is the (to-be-printed) top side of the recording medium 20. In an exemplary embodiment, the surface charging station 310 can include processor circuitry configured to generate and/or apply the charged layer 314 of charged particles from the second side of the recording medium 20. In an exemplary embodiment, additionally or alternatively to the processor circuitry of the surface charging station 310, the controller 60 can be configured to generate and/or apply the charged layer 314 of charged particles from the second side of the recording medium 20.

The charged particles (and therefore the charged layer 314) applied onto the second side of the recording medium 20 have a second polarity that is opposite the first polarity of the toner particles. For example, the second polarity may be a negative polarity that is opposite a first, positive polarity of the toner particles.

Via the layer 314 of charged particles, a charged layer 314 may thus be provided that attracts the oppositely charged toner particles from the transfer roller 121 towards the first side (in the direction of the second side) of the recording medium 20. In other words: via the charged layer 314 of charged particles, an electrical field is generated that attracts the oppositely charged toner particles towards the first side of the recording medium 20. The transfer efficiency of the transfer station 120 may thus be reliably increased. Due to the fact that the charged layer 314 with the second polarity is located on the second side of or inside (near the second side) the recording medium 20, an unregulated discharging of the toner particles and/or an unregulated interaction with the liquid developer cannot occur.

The surface charging station 310 may comprise one or more corotrons 312 that are configured to generate a corona or a plasma 313 on or in front of (for example in an environment in front of) the second side of the recording medium 20.

In particular, air may be ionized by the one or more corotrons 312.

The ions of the second polarity may then be applied as a charged layer 314 of charged particles onto the second side of the recording medium 20. For this purpose, the surface charging station 310 may comprise a counter-electrode 311 that is arranged on or in front of (for example in an environment in front of) the first side of the recording medium 20, and that is configured to attract ions from the corona or the plasma 313 with the second polarity towards the recording medium 20 in order to apply the charged layer 314 of charged particles from the second side of the recording medium 20. The counter-electrode 311 may thereby possibly contact the surface of the first side of the recording medium 20, for example in order to produce an optimally large force on the ions. On the other hand, an air gap may be provided between the counter-electrode 311 and the surface of the first side of the recording medium 20, for example in order to preserve a print image that is already present on the first side of the recording medium 20.

The penetration of the ions with the second polarity into the inside of the recording medium 20 may be regulated via a field strength of the electrical field generated by the counter-electrode 311. In particular, the electrical field generated by the counter-electrode may be such that the ions are not (substantially) pulled through the recording medium 20 to the first side of said recording medium 20. The electrical field generated by the counter-electrode may be such that a distribution of charged particles across the cross section of the recording medium 20, from the second side to the first side, results that decreases towards the first side (and is substantially zero at the first side). In an exemplary embodiment, the processor circuitry of the surface charging station 310 can be configured to determine the field strength of the electrical field generated by the counter electrode 311 to regulate the penetration of the ions. In an exemplary embodiment, additionally or alternatively to the processor circuitry of the surface charging station 310, the controller 60 can be configured to determine the field strength of the electrical field generated by the counter electrode 311.

The counter-electrode 311 typically has a clearance from the first side of the recording medium 20. The clearance thereby encompasses at least a height of a print image 20' that is already located on the first side of the recording medium 20. It may thus be ensured that the counter-electrode 311 is arranged sufficiently close to the first side of the recording medium 20 in order to generate a sufficient electrical field so that the ions with the second polarity are introduced into the recording medium 20 from the second side of said recording medium 20. On the other hand, an already applied print image 20' is protected from damage by the clearance.

The surface charging station 310 can be configured to adapt an energy and/or a spatial distribution of the corona or of the plasma 313 depending on one or more parameters. In an exemplary embodiment, the processor circuitry of the surface charging station 310 can be configured to adapt the energy and/or spatial distribution of the corona or of the plasma 313 depending on the one or more parameters. In an exemplary embodiment, additionally or alternatively to the processor circuitry of the surface charging station 310, the controller 60 can be configured to adapt the energy and/or spatial distribution of the corona or of the plasma 313 depending on the one or more parameters. The one or more parameters may include one or more of: the humidity in the environment in front of the second side of the recording medium 20; the moisture of the recording medium 20; the thickness of the recording medium 20; and/or the material of the recording medium 20. By taking into account one or more parameters in the generation of the charged layer 314, it may be ensured that—even given changing conditions—an electrical field is generated by the charged layer 314 generated by the surface charging station 310 such that the toner particles reliably transfer with a uniformly high transfer efficiency from the transfer roller 121 onto the first side of the recording medium 20.

In an exemplary embodiment, the surface charging station 310 can be configured such that a charged layer 314 is generated over the entire region of the recording medium 20 that is to be printed, including over the entire print width. For this purpose, the surface charging station 310 may comprise a plurality of corotrons 312 that are arranged over the width of the recording medium 20, transversal to the transport direction 20".

The transfer station may additionally comprise a counter-pressure roller 126 that is configured to press the recording medium 20 onto the transfer roller 121 at the transfer point. For this purpose, the counter-pressure roller 126 is in contact with the second side of the recording medium 20. The counter-pressure roller 126 may have a dielectric outer layer. A flow of the charged particles of the charged layer 314 away across the counter-pressure roller 126 may thus be avoided, or at least slowed.

The transfer station may additionally include a voltage source that is configured to generate an electrical field 302 between the transfer roller 121 and the counter-pressure roller 126, which has the effect that the toner particles are drawn onto the first side of the recording medium 20. The transfer efficiency may be further increased (even given thick recording media 20) via the generation of an additional electrical field 302 which assists the electrical field generated by the charged layer 314.

Figure 4:
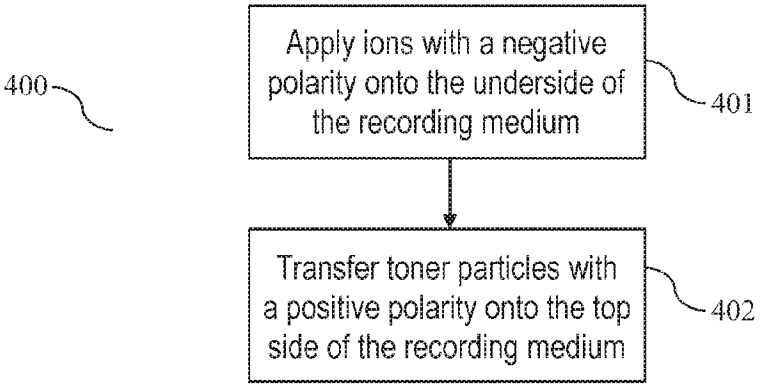
FIG. 4 illustrates a method for increasing the toner transfer efficiency of a transfer station according to an exemplary embodiment of the present disclosure.

FIG. 4 shows a workflow diagram of an example method 400 to increase the toner transfer efficiency of a transfer station 1120. The method 400 includes the application 401 of a charged layer 314 of charged particles (ions, for example) from a second side (the underside, for example) of a recording medium 20. The charged particles—and therefore the layer 314—thereby have a second polarity (a negative polarity, for example). The method 400 additionally includes the transfer 402 of toner particles from a liquid developer 301 onto a first side (a top side, for example) of the recording medium 20 that is opposite the second side. The toner particles have a first polarity (a positive polarity, for example) that is opposite the second polarity.

The transfer station 120 described in this document, and the corresponding method 400, enable an increase of the transfer efficiency at the transfer point of the transfer station 120 given a reduced voltage difference between transfer roller 121 and counter-pressure roller 126. The danger of a breakdown may thus be reduced. Furthermore, an increased adhesion of already deposited toner layers from upstream print groups 11 is achieved via the applied charged layer 314. This prevents a return transfer of color separations that have already been transfer-printed. The color separations remain at uniform quality, although they pass additional transfer points of additional print groups 11. Moreover, an interaction of the applied charged particles with the liquid developer may be reduced or entirely suppressed via the application of a charged layer 314 on the side of the recording medium 20 that is situated opposite the side to be printed. Overall, additional degrees of freedom in the selection of recording media 20 to be printed (in particular with regard to the thickness of the recording medium 20 that is to be printed to and/or with regard to the grammage of the recording medium 20 that is to be printed to) result via the transfer station 120 described in this document.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

A reference list is provided below.

10 digital printer
11, 11*a*-11*d* print group (front side)
12, 12*a*-12*d* print group (back side)
20 recording medium
20' print image (toner)
20" transport direction of the recording medium
21 roll (input)
22 take-off
23 conditioning group
24 turner
25 register
26 puller
27 take-up
28 roll (output)
30 fixer
40 climate controller
50 power supply
60 controller
70 fluid management system
71 fluid controller
72 storage reservoir
100 electrophotography station
101 photoconductor, photoconductor roller
102 erasure light
103 cleaner (photoconductor)
104 blade (photoconductor)
105 collection container (photoconductor)
106 charger (corotron)
106' wire
106" shield
107 feed channel (aeration)
108 exhaust channel (ventilation)
109 character generator
110 developer station
111 developer roller
112 storage chamber
112' fluid feed
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge
120 transfer station
121 transfer roller
122 cleaner (wet chamber)
123 cleaning brush (wet chamber)
123' cleaning fluid feed
124 cleaning roller (wet chamber)
124' cleaning fluid discharge
125 blade
126 counter-pressure roller
127 cleaner (counter-pressure roller)
128 collection container (counter-pressure roller)
128' fluid discharge
129 charger (corotron at transfer roller)
301 liquid developer with charged toner particles
302 electrical field
310 surface charger
311 counter-electrode
312 corotron
313 corona or plasma
314 Layer with charged particles
400 method to increase the toner transfer efficiency
401, 402 method steps

What is claimed is:

1. A transfer station for a digital printer, comprising:

a transfer roller configured to direct liquid developer with toner particles towards a first side of a recording medium and onto the first side of the recording medium at a transfer point, the toner particles having a first polarity, and the recording medium moving past the transfer roller along a transport direction; and a surface charging station arranged before the transfer point in the transport direction, the surface charging station being configured to apply a layer of charged particles from a second side of the recording medium, the second side being opposite the first side, and the charged particles having a second polarity that is opposite the first polarity.

2. The transfer station according to claim 1, wherein the surface charging station comprises:

a corotron that is configured to generate a corona or plasma at or in front of the second side of the recording medium.

3. The transfer station according to claim 2, wherein the surface charging station further comprises:

a counter-electrode arranged at or in front of the first side of the recording medium and configured to attract ions with the second polarity towards the recording medium to apply the layer of charged particles from the second side of the recording medium.

4. The transfer station according to claim 3, wherein:

the counter-electrode has a clearance from the first side of the recording medium; and the clearance encompasses a height of a print image already located on the first side of the recording medium.

5. The transfer station according to claim 2, wherein:

the surface charging station is configured to adapt an energy and/or a spatial distribution of the corona or of the plasma depending on one or more parameters; and the one or more parameters include one or more of: a humidity in the environment in front of the second side of the recording medium, a moisture of the recording medium, a thickness of the recording medium, and a material of the recording medium.

6. The transfer station according to claim 1, further comprising:

a counter-pressure roller that is configured to press the recording medium onto the transfer roller at the transfer point; wherein the counter-pressure roller has a dielectric outer layer.

7. The transfer station according to claim 6, further comprising:

a voltage source configured to generate an electrical field between the transfer roller and the counter-pressure roller to cause the toner particles to be drawn toward the first side of the recording medium.

8. The transfer station according to claim 1, wherein the first polarity is a positive polarity and the second polarity is a negative polarity.

9. The transfer station according to claim 1, wherein the toner particles are arranged on the transfer roller according to a print image to be printed onto the recording medium.

10. A method to increase toner transfer efficiency of a transfer station, comprising:

providing a recording medium with first and second opposite sides;

applying a layer of charged particles from the second side of the recording medium, the charged particles having a second polarity; and transferring toner particles from a liquid developer onto the first side of the recording medium, the toner particles having a first polarity that is opposite the second polarity.

11. A transfer station for a digital printer, comprising:

a transfer roller configured to direct liquid developer with toner particles to a transfer point on a first side of a recording medium; and a surface charging station configured to apply charged particles to the recording medium from a second side of the recording medium opposite the first side, the charged particles being configured to attract the toner particles to the recording medium.

12. A method to increase toner transfer efficiency of a transfer station, comprising:

generating charged particles;

applying a layer of the charged particles from a second side of a recording medium; and transferring toner particles from a liquid developer onto a first side of the recording medium that is opposite the second side, the charged particles being configured to attract the toner particles to the recording medium.

* * * * *